US005648786A

United States Patent [19]

Chung et al.

[11] Patent Number: 5,648,786

[45] Date of Patent: Jul. 15, 1997

[54] CONFORMAL LOW PROFILE WIDE BAND SLOT PHASED ARRAY ANTENNA

[75] Inventors: Hsin-Hsien Chung; Jeffrey A. Douglass, both of San Diego, Calif.

[73] Assignee: TRW Inc., Redondo Beach, Calif.

[21] Appl. No.: 562,533

[22] Filed: Nov. 27, 1995

[51] Int. Cl.[6] ..... H01Q 13/10; H01Q 11/10

[52] U.S. Cl. ..... 343/770; 343/767; 343/792.5

[58] Field of Search ..... 343/770, 789, 343/705, 872, 853, 700 MS, 792.5, 767, 803

[56] References Cited

U.S. PATENT DOCUMENTS

| | | | |
|---|---|---|---|
| 3,369,243 | 2/1968 | Greiser | 343/770 |
| 3,633,207 | 1/1972 | Ingerson | 343/720 |
| 4,594,595 | 6/1986 | Struckman | 343/770 |
| 4,922,262 | 5/1990 | Chow | 343/792.5 |
| 5,068,670 | 11/1991 | Maoz | 343/770 |
| 5,337,065 | 8/1994 | Bonnet et al. | 343/767 |
| 5,502,453 | 3/1996 | Tsukamoto et al. | 343/700 MS |

OTHER PUBLICATIONS

Paul G. Ingerson and Paul E. Mayes, "Log Periodic Antennas with Modulated Impedance Feeders", *IEEE Transactions on Antennas and Propagation, vol. AP–16, No. 6, Nov. 6, Nov. 1968*, pp. 633–642.

*Primary Examiner*—Donald T. Hajec
*Assistant Examiner*—Tan Ho
*Attorney, Agent, or Firm*—Michael S. Yatsko

[57] ABSTRACT

A cavity-backed slot array antenna is provided which offers wide frequency bandwidth in a conformal structure and further offers forward horizon coverage and wide angle beam scanning. The slot array antenna has a plurality of cavity-backed slot arrays. Each array contains a plurality of conductive cavities and radiating slots. The conductive cavities have varying size length and width in accordance with a log-periodic scale and, some conductive cavities have a maximum constant width. The slots are preferably formed in a folded configuration extending along a substantial portion of the width of the conductive cavity and further extend along a portion of the length of the conductive cavity one or more times. For a conductive cavity at maximum width, the corresponding slots are further extended in the effective overall length so as to further extend the frequency bandwidth, while maintaining a compact antenna structure.

15 Claims, 4 Drawing Sheets

CONFORMAL LOW PROFILE WIDE BAND SLOT PHASED ARRAY ANTENNA

BACKGROUND OF THE INVENTION

1. Technical Field

The present invention generally relates to antenna systems and, more particularly, to a cavity-backed periodic slot array antenna with a compact conformal and low profile structure that realizes wide frequency bandwidth.

2. Discussion

Low profile conformal antennas have become particularly useful for transmit and receive communications systems such as advanced identification of friend or foe (AIFF), data link and satellite communications systems. These and other types of communications systems are often selected to operate over various selected frequencies and the useful frequency range is generally dependent on the antenna design. In this regard, conventional slot antennas and printed microstrips for patch antennas have been developed and used for such applications and can generally be made with small low profile structures.

In particular, cavity-backed slot antennas have been mounted on the outer surface of aircraft and on various other airborne and ground objects in the past. The conventional slot antenna typically included a slot etched in a conductive surface near a conductive cavity which in turn communicates with a feed line. The physical dimensions of the slot and conductive cavity generally determine the effective frequency range of operation. For instance, for phased array applications, the spacing between elements of the array should generally be kept less than one-half the wavelength of the operating signals to avoid any potential grating lobes in the antenna pattern. However, many of the conventional cavity-backed slot antennas are generally effectively limited to a narrow frequency bandwidth. Hence, in order to achieve a cavity-backed slot antenna that is more useful for applications which require a wider frequency range, the frequency bandwidth needs to be extended.

More recently, cavity-backed log-periodic slot array antennas have been developed and are generally made up of a plurality of individual slot and cavity elements configured in a linear array according to a log-periodic scale. That is, the physical dimensions of width, length and thickness of the individual cavities generally increase from small to larger cavities in accordance with a log-periodic scale. In addition, the radiating slots typically extend along a portion of the width of the corresponding cavity and likewise increase in size with larger width cavities. By employing several varying size cavities and slots, the overall frequency bandwidth of the antenna can be extended over a wider frequency range.

The log-periodic slot array advantageously performs more like a frequency independent antenna with uniform gain and end-fire pattern shape over an extended frequency range. However, the conventional log-periodic slot array generally suffers from a number of deficiencies. For example, the conventional log-periodic slot array can become quite large, especially in width, and therefore often impracticable for use in many airborne phased array applications. This is generally due in part to the fact that the conventional slots extend the width of the individual conductive cavities and the conductive cavities are formed with an inside physical dimension to accommodate lower frequency signals. Also, the non-constant thickness of the conductive cavities of the conventional slot arrays is difficult to fabricate and can be excessive in size, especially for large arrays, making it difficult to realize a low profile conformal configuration. Additionally, beamwidth of the conventional log-periodic slot array can be too narrow for use in a wide angle scan phased array. Also, cross-polarization levels may be high at wide angles with many known conventional approaches.

It has become increasingly important that antennas employed for avionics systems and the like, such as those used on high performance fighter aircraft, be conformal and have a very low profile structure suitable for use on the exterior surface of the aircraft. However, the conventional conformal and low profile antennas, in general, have inherent characteristics that often make it very difficult and sometimes impracticable to employ a conventional slot antenna that meets a particular set of stringent performance requirements which are often imposed for such aircraft use and the like.

It is therefore desirable to provide for a compact log-periodic slot array antenna that is suitable for conformal low profile wideband phased array applications. It is also desirable to provide for such a compact slot array antenna which may provide forward horizon coverage and be capable of providing wide angle beam scanning. It is further desirable to provide for such a slot array antenna that may be used on advanced avionic systems such as high performance fighter aircraft and offers a low profile and conformal structure. Yet, it is also desirable to provide for a cavity backed slot antenna element with small physical dimensions and which is able to realize an extended frequency bandwidth.

SUMMARY OF THE INVENTION

In accordance with the teachings of the present invention, a conformal low profile periodic slot array antenna is provided which offers a broad frequency range, forward horizon coverage and wide angle beam scanning. For increased gain as well as beam scanning, the periodic slot array antenna may include a plurality of arrays, each array having a plurality of conductive cavities adjacent to one another with varying conductive cavity sizes in accordance with a log-periodic scale. An array of radiating slots is formed in a conductive surface in close proximity to and in communication with the conductive cavities. The slots are preferably formed in a folded configuration extending along a portion of the width and length of the conductive cavities so as to allow for a realization of reduced conformal cavity size. The slots also increase in size, preferably in accordance with a log-periodic scale. A plurality of conductive cavities may have substantially equal width, while the overall effective length of the corresponding slots is further increased so as to extend the frequency range of the antenna, while maintaining a conformal low profile structure that is quasi log-periodic.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
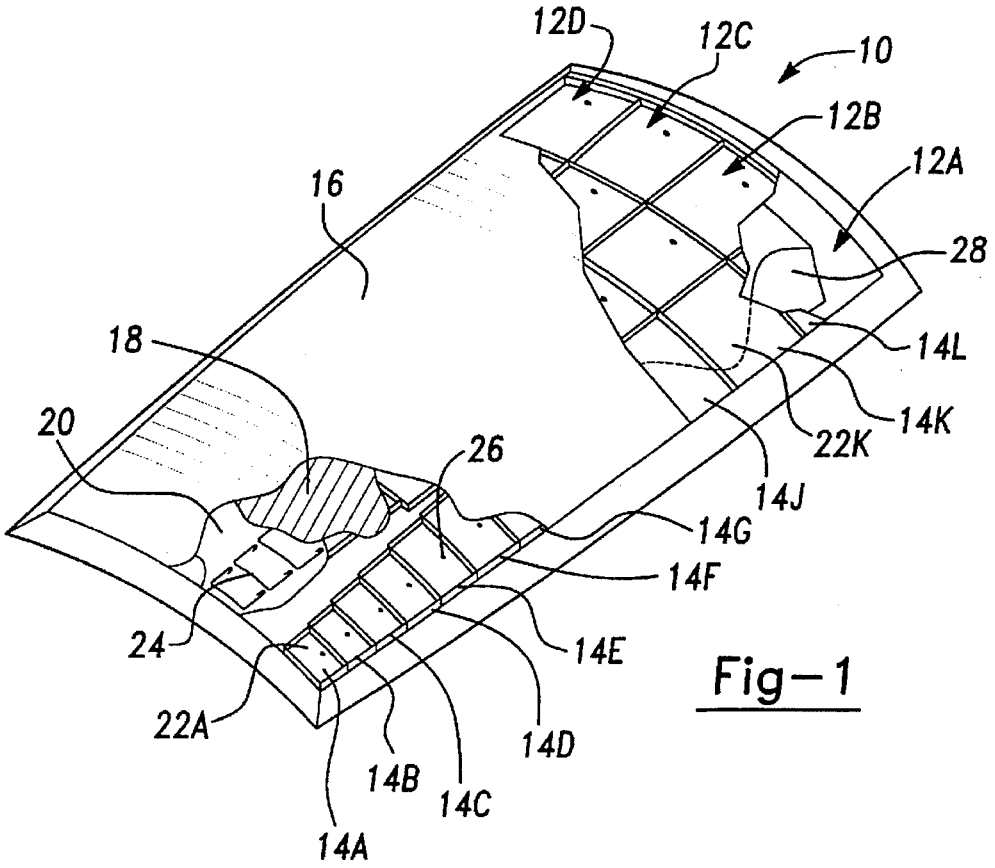
FIG. 1 illustrates a conformal low profile quasi log-periodic slot array antenna in accordance with the present invention.
Figure 2:
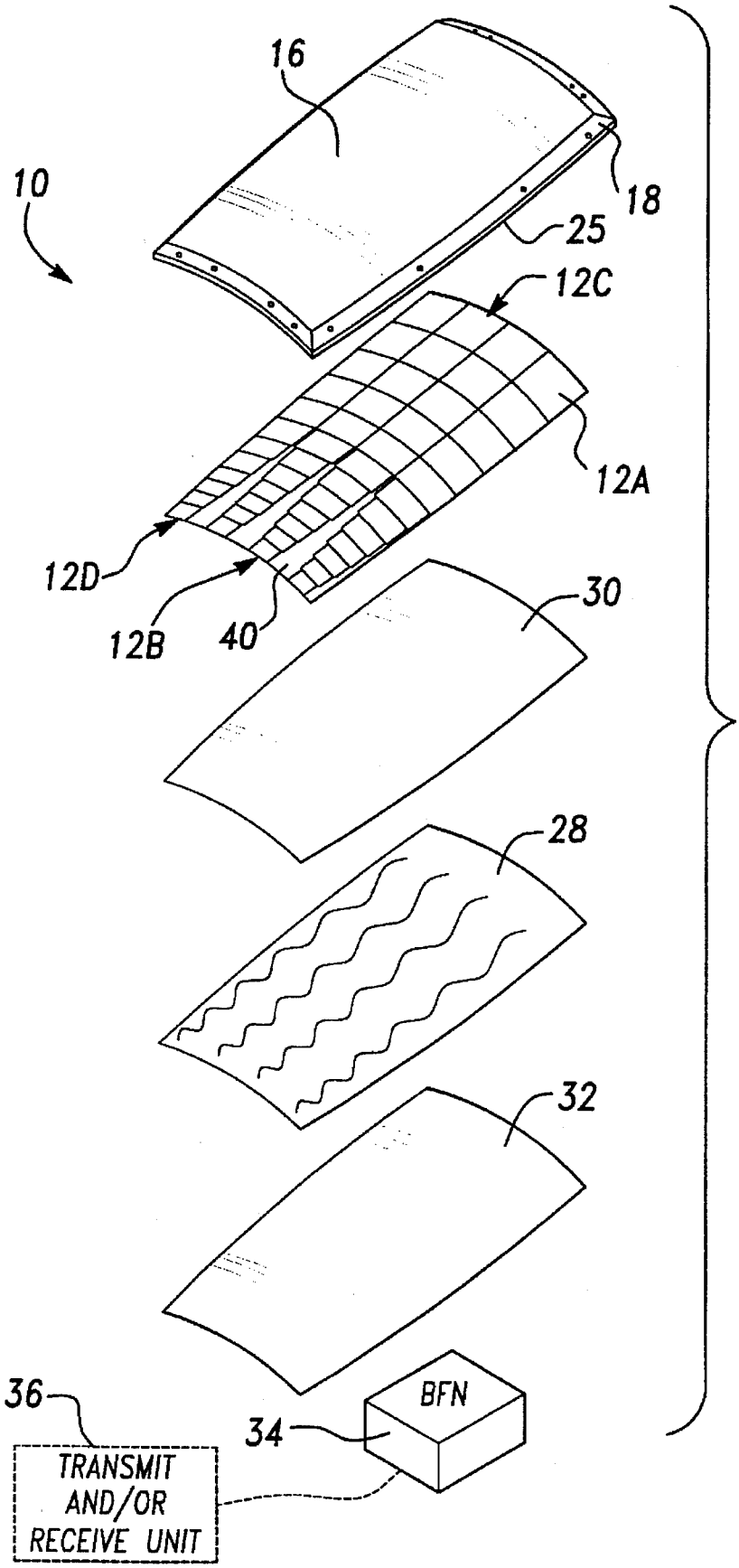
FIG. 2 is an exploded view illustrating individual layers of the quasi log-periodic slot array antenna shown in FIG. 1.

Turning now to FIG. 1, a quasi log-periodic slot array (QLPSA) antenna 10 is illustrated in a conformal low profile antenna structure as shown in FIG. 1 and an exploded view as provided in FIG. 2 in accordance with one embodiment of the present invention. The slot array antenna 10 as shown and described herein is a four-by-twelve array which includes four adjacent quasi log-periodic slot arrays 12A through 12D each containing an array of twelve slot array elements 14A through 14L. While a four-by-twelve slot array configuration is disclosed according to one embodiment, any number of slot arrays and slot array elements may be used as is required for a given application.

Each of the slot array elements 14A through 14L contains a conductive cavity. That is, elements 14A through 14L contain respective conductive cavities 22A through 22L. The conductive cavities 22A through 22L generally increase in size in accordance with a log-periodic scale as will be explained in more detail hereinafter. The conductive cavities 22A through 22L are rectangularly shaped cavities fabricated in a cavity support layer 40 which may include a dielectric support layer. Dielectric material in the conductive cavity would further reduce the physical size of the cavity for a given frequency of operation but at the expense of reduced antenna efficiency and/or bandwidth. According to one embodiment, the conductive cavities are formed of conductive walls soldered together with a conductive surface on bottom. Alternately, a plurality of closely-spaced conductive vias configured in a rectangular shape could be used to form the conductive cavities. A detailed discussion of conductive vias used for a cavity-backed slot antenna can be found in U.S. patent application Ser. No. 07/909,482, filed Jul. 6, 1992, entitled "Printed Dual Cavity-Backed Slot Antenna", now U.S. Pat. No. 5,446,471, which is hereby incorporated by reference.

Located on top of the conductive cavities 22 is a conductive layer 25 with radiating slots 24 fabricated therein. Radiating slots 24 may be formed by etching or removing a copper clad material from the conductive surface 25 using standard photolithographic techniques or other known techniques. Preferably, one radiating slot 24 is formed in the top conductive surface 25 of each element 14 to allow electromagnetic energy to radiate through the slot 24 and either into or away from the conductive cavity 22 located below.

A radome housing 16 is provided as the top layer of the QLPSA antenna 10. The radome housing 16 is preferably constructed of low dielectric constant material with low loss tangent. Radar absorbing material (RAM) 18 is preferably sandwiched between the radome housing 16 and conductive layer 25. Layers 18, 16 and 25 are bonded together to form a complete radome layer.

The conductive cavities 22A through 22L are also in communication with a plurality of coupling probes 26 and feed line structure which is located below the cavities and illustrated herein as a stripline feed circuit generally made up of layers 28 and 30. The stripline feed circuit includes a printed conductive strip which may be formed by standard photolithographic techniques with a copper clad initially provided on the top surface of a substrate board and etched away so the feed line strip remains thereon. The feed line strip includes a conductive layer both above and below the conductive strip and dielectrically separated therefrom in accordance with well known stripline circuit configurations. Alternately, the feed line may include a microstrip feed circuit with one of the adjacent conductive layers removed. A housing back plate 32 is provided below stripline feed 28. Housing back plate 32 may include a conductive material which can also operate as the bottom conductive layer for the stripline feed in lieu of the conductive layer below the feed line as explained above.

A beam forming network assembly 34 is shown on the bottom of the antenna 10. The beam forming network assembly 34 may include a printed circuit pattern that provides phase shifting to accommodate a scannable phased array antenna beam. The beam forming network assembly 34 is preferably coupled to a transmit and/or receive unit 36 such as a transmitter, receiver or transceiver as should be evident to one skilled in the art.

Figure 3:
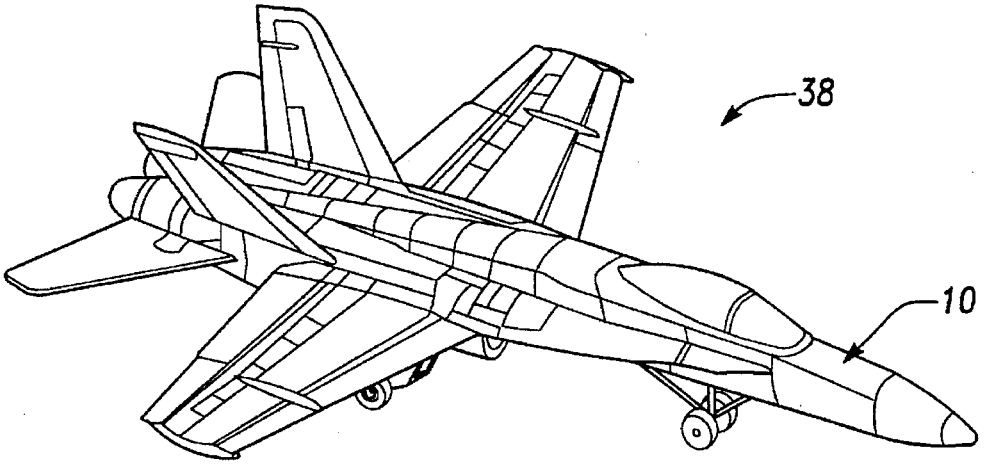
FIG. 3 illustrates a high performance aircraft employing the slot array antenna conformally mounted on the airframe thereof.

The individual layers of the log-periodic slot army antenna 10 may be constructed of composite material such as epoxy graphite and the layers are preferably bonded together to provide a compact and a conformal low-profile structure. Bonding between layers may be achieved with standard bonding techniques such as epoxy adhesive bonding. The conformal low profile slot array antenna 10 is particularly suitable for surface mounting onto the airframe of an aircraft such as aircraft 38 shown in FIG. 3. Generally speaking, the conformal low profile antenna structure is advantageously superior for use in applications where the size requirements of the antenna are limited, while at the same time high performance antenna requirements remain. While the present invention is described in connection with use for aircraft applications, it should be appreciated that the antenna of the present invention is also well suited for use on satellites, ground vehicles and various other applications.

Figure 4:
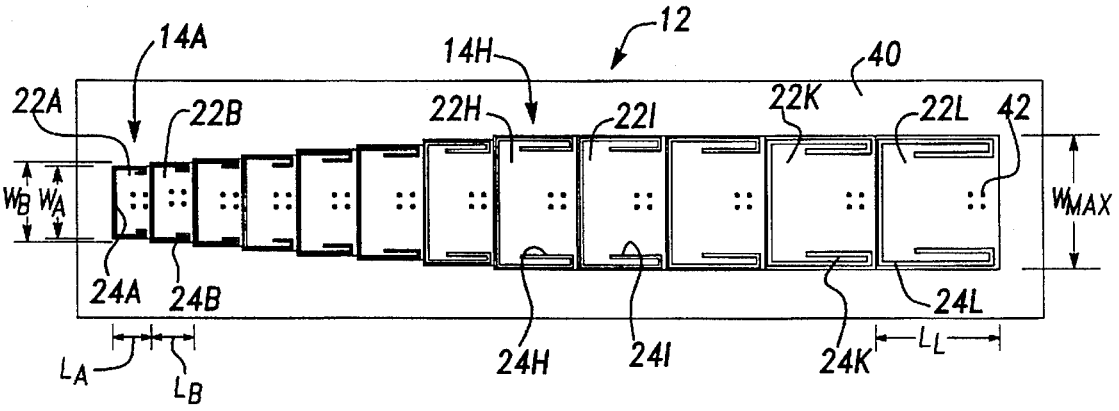
FIG. 4 is a top view of a fully assembled twelve element quasi log-periodic slot array antenna according to the present invention.

Referring to FIG. 4, one array 12 of the slot array antenna 10 is illustrated from a top view with the radome housing 16 and radar absorbing material 18 removed. According to one embodiment, the physical dimensions of width and length of the conductive cavities 22A through 22H increase in size for corresponding elements 14A through 14H. That is, at the narrow end of the array 12, conductive cavity 22A of element 14A has physical dimensions of width $W_A$ and length $L_A$. The next largest element 14B has a conductive cavity 22B with a width that is larger than width $W_A$, and similarly a length that is larger than length $L_A$. Referring toward the other end of array 12, element 14H has a conductive cavity 22H with physical dimensions of width $W_{MAX}$ and length $L_H$. Width $W_{MAX}$ is the maximum width found on the array 12, while length $L_L$ has an length that is larger than the length of the smaller conductive cavities 22B through 22G.

For wide bandwidth, the size of the conductive cavities increases according to a log-periodic scale and the effective overall length of the radiating slots 24 also increases, preferably in accordance with a log-periodic scale. In order to allow for reduced cavity size, each of the radiating slots 24 preferably extend along a substantial portion of the width of the corresponding conductive cavity 22 and also extend along a portion of the length of the corresponding conductive cavity 22. Furthermore, the radiating slots 24 are formed in a folded configuration with the slots 24 folded back along the length one or more times to provide for an extended effective overall length of the slot 24. Also, the slots 24 are preferably formed near the inner conductive walls of the corresponding conductive cavities 22, except the folded back portions which fold toward the center of the cavity.

For the remaining slot array elements 14I through 14L at the wider end of the array 12, the respective conductive cavities 22I through 22L preferably have a uniform width equal to the maximum cavity width $W_{MAX}$. This provides for an overall narrow array 12. The length of individual conductive cavities 22H through 22L may continue to increase in size. However, length of larger conductive cavities 22H through 22L may also remain equal to provide a shortened array 12, if desired.

While the width of the conductive cavities 22 is limited to a maximum allowable width $W_{MAX}$, the effective overall length of the corresponding radiating slots 24 continue to increase for subsequent elements 14H through 14L. That is, while the conductive cavity width for conductive cavities 22H through 22L remain constant, the effective slot length for radiating slots 24H through 24L continue to increase for each successive element. Accordingly, by increasing the effective slot length the operating frequency for the corresponding element may accommodate a longer wavelength signal, thereby extending the overall operating frequency for the array 12.

Figure 5:
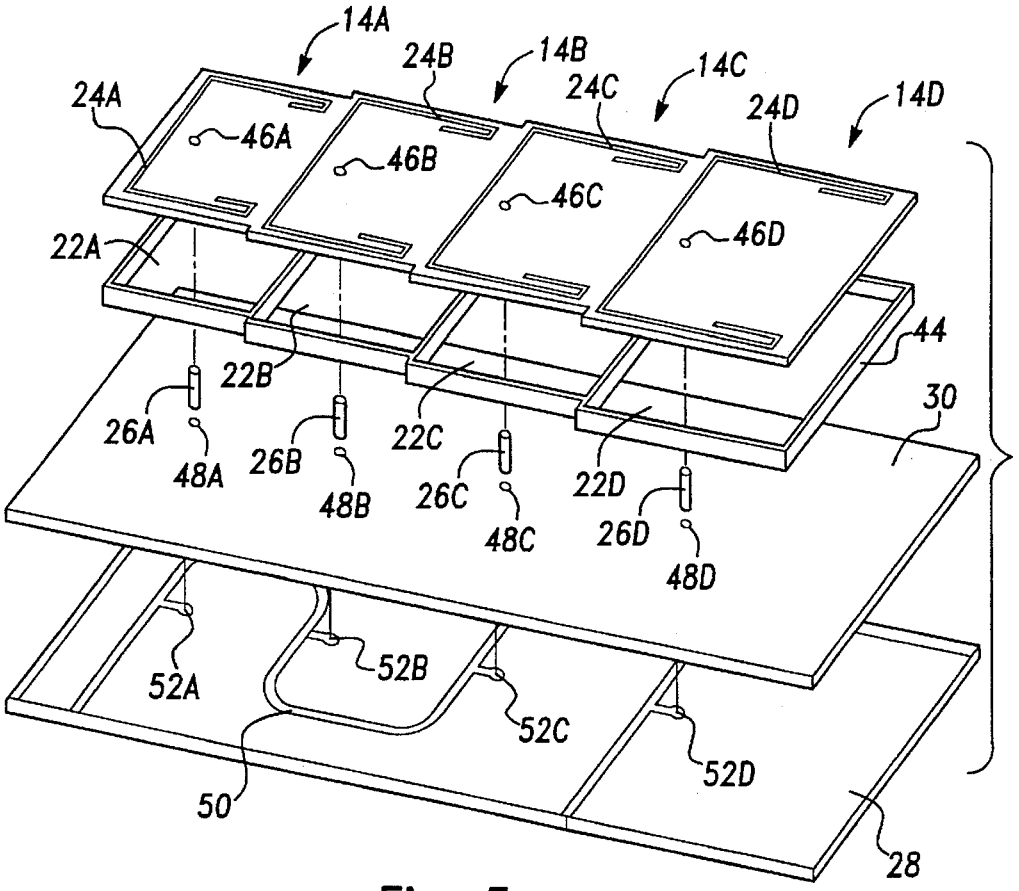
FIG. 5 is an exploded view of a portion of the quasi log-periodic slot array antenna illustrating the slot, cavity and feed configuration.
Figure 6A:
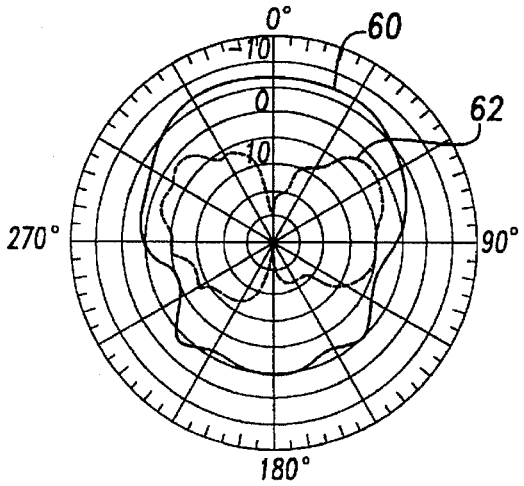
FIGS. 6A through 6D are graphs which illustrate measured azimuth patterns exhibited by one example of the quasi log-periodic slot array antenna of the present invention.
Figure 6B:
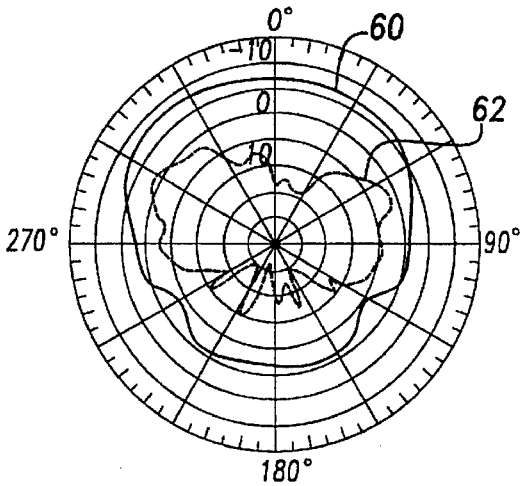
Figure 6C:
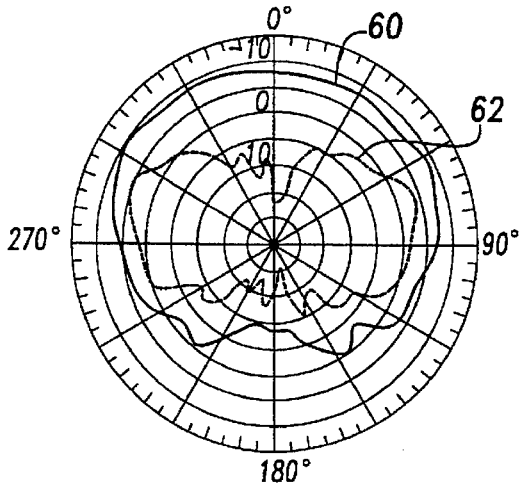
Figure 6D:
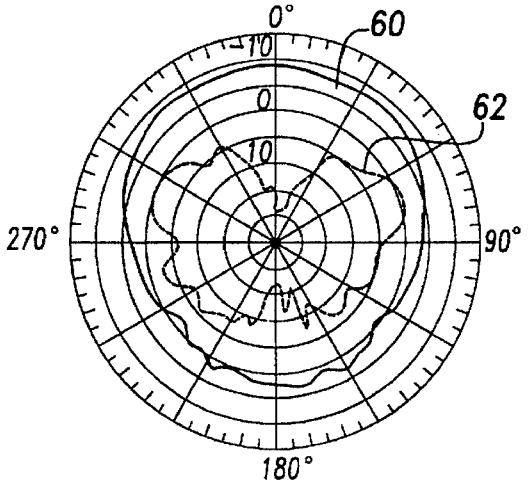

With particular reference to FIG. 5, a portion of array 12 is illustrated therein in an exploded view showing four elements 14A through 14D. Feed circuit layer 28 contains printed meander-line stripline or microstrip feed circuitry 50 fabricated on the top surface thereof. Feed circuit 50 contains contact pads such as contact pads 52A through 52D, each of which contacts a conductive probe. Conductive probes such as probes 26A through 26D extend through respective conductive cavities 22A through 22D and contact corresponding contact pads 52A through 52D. Additionally, holes 46A through 46D are provided in the cavity support layer 40 to allow the corresponding probes 26A through 26D to extend therethrough, while holes 48A through 48D in layer 30 also allow the conductive probes 26A through 26D to extend therethrough.

The use of a conductive probe extending through a corresponding conductive cavity such as conductive probe 26A extending through cavity 22A allows each slot cavity to be excited through probe coupling. Therefore, when receiving radiating energy, the radiating energy, generally within a limited frequency band for each element 14, passes through slot 24A and propagates within conductive cavity 22A. At the same time, the propagating radiating energy is picked up by conductive probe 26A where it passes on to feed circuit 50 via conductive pad 52A. Similarly, element 14B will likewise operate to receive radiating energy which is passed through conductive probe 26B onto contact pad 52B and circuit 50. Element 14B, however, with increased size cavity and slot dimensions will have a different operating frequency bandwidth. The total energy received from all of elements 14A through 14L is accumulated on feed circuit 50 and may be passed on to a receive device for processing.

For transmitting operations, a transmit device injects energy onto feed circuit 50 which in turn passes the energy to each of the conductive probes 26. The energy on conductive probes 26 in turn may excite or induce radiating energy within conductive cavity 22. The radiating energy in turn may pass through radiating slot 24 and radiate out therefrom.

The quasi log-periodic slot array antenna 10 of the present invention advantageously allows for a low profile and conformal antenna structure with good antenna performance and a wide frequency bandwidth. The folded slot design realizes an extended slot length suitable for conductive cavities constructed for reduced dimensions. The extended overall length of the radiating slots allows for use of smaller more compact conductive cavities and provides a compact antenna structure. With the width of each array confined to a maximum overall width, the radiating slots, extended in the overall effective length, further allow for operation of lower frequency signals, without requiring a larger conductive cavity. Furthermore, the log-periodic slot array antenna 10 preferably has a uniform constant thickness of the conductive cavity to allow for suitable surface mounting or flush mounting on surfaces which require low profile surface contours.

It should be appreciated that the quasi log-periodic slot array antenna 10 has been described in connection with four arrays 12A through 12D, each array containing twelve elements 14A through 14L. The multiple array configuration advantageously allows for generation of a scannable beam. Beam scanning may be achieved by employing a beam forming network which provides a phase shift among the different arrays 12A through 12D as should be evident to one skilled in the art. Alternately, beam scanning may also be achieved by orienting the arrays 12A through 12D in different directions. Also, a single array 12 may be used as a stand-alone antenna structure to provide a narrow, low profile and conformal array with a wide frequency bandwidth. This allows for a more compact antenna, however, the overall beam pattern may be more limited than the multiple array design.

The quasi log-periodic slot array antenna 10, according to an L-band example, may have a substantially uniform thickness of less than one inch for easy mounting on the airframe of a high performance aircraft. Referring to FIGS. 6A through 6D, measured azimuth pattern for a single array 12 containing twelve elements as described in connection with the array 12 in FIG. 4 is provided for a frequency of 900 megahertz in FIG. 6A, 1,200 megahertz in FIG. 6B, 1,500 megahertz in FIG. 6C and 1,800 megahertz in FIG. 6D. Solid lines 69 indicate vertical polarization, while dashed lines 62 indicate horizontal polarization. Accordingly, good azimuth patterns are achievable over a wide frequency range.

In view of the foregoing, it can be appreciated that the present invention enables the user to achieve a conformal low profile slot array antenna with wide band frequency capability. Thus, while this invention has been disclosed herein in connection with a particular example thereof, no limitation is intended thereby except as defined in the following claims. This is because a skilled practitioner recognizes that other modifications can be made without departing from the spirit of this invention after studying the specification and drawings.

What is claimed is:

1. A cavity-backed slot antenna comprising:

a first array of conductive cavities extending from a first end to a second end, each of said first array of conductive cavities having inner conductive walls, said first array of conductive cavities having a length and a width of the cavities increasing in size from said first end toward said second end in accordance with a log-periodic scale;

a second array of conductive cavities at said second end, said second array of conductive cavities having substantially the same width;

a top conductive surface provided above the conductive cavities;

an array of slots formed in the top conductive surface and at least a portion of each of the slots is provided in close proximity to at least one of the inner conductive walls of the conductive cavities, said slots increasing in effective length from said first end toward said second end; and feed means for communicating with the first array of conductive cavities.

2. The slot antenna as defined in claim 1 wherein each of said slots extends at least a portion of the width of said cavities and further extends at least a portion of the length of said cavities so as to enhance frequency bandwidth.

3. The slot antenna as defined in claim 2 wherein each of said slots further is folded to extend again along the length of a cavity.

4. The slot antenna as defined in claim 1 wherein each of said second array of conductive cavities is in close proximity to a different one of said slots and the slots have varying size lengths.

5. The slot antenna as defined in claim 1 wherein said feed means is coupled to the array of conductive cavities via coupling probes.

6. The slot antenna as defined in claim 1 wherein said feed means comprises a stripline feed.

7. The slot antenna as defined in claim 1 wherein said feed means comprises a microstrip feed.

8. The slot antenna as defined in claim 1 wherein said array of cavities have substantially equal thickness.

9. A conformal wide band cavity-backed slot antenna comprising:

a first and second array of conductive cavities extending from a first end to a second end, said first array of conductive cavities having a width which increases in size from said first end toward said second end in accordance with a log-periodic scale, each of said second array of conductive cavities having a substantially equal width;

an array of slots formed in a conductive surface and in close proximity to the array of conductive cavities so that different slots are in communication with different ones of said conductive cavities, each of said slots having an effective length that is increased from said first end toward said second end; and feed means for communicating with the array of conductive cavities, wherein said slots toward said second end increase in overall length with a folded slot configuration.

10. The slot antenna as defined in claim 9 wherein each of said slots extends at least a portion of the width of said cavities and further extends at least a portion of the length of said cavities so as to enhance frequency bandwidth.

11. The slot antenna as defined in claim 10 wherein each of said slots further is folded to extend again along the length of a cavity.

12. The slot antenna as defined in claim 9 wherein said feed means is coupled to the array of conductive cavities via coupling probes.

13. The slot antenna as defined in claim 9 wherein said first and second arrays of cavities have substantially equal thickness.

14. A cavity-backed slot element comprising:

a conductive cavity including conductive walls having an inner width and an inner length and a conductive top layer;

a slot formed in said top conductive layer for communicating with said conductive cavity, said slot extending along at least a portion of the width of said conductive cavity and further extending along at least a portion of the length of said conductive cavity, wherein said slot is configured with arms folded back along the length of said conductive cavity; and feed means for communicating with said conductive cavity.

15. The slot element as defined in claim 14 wherein at least a portion of the slot is formed in close proximity to one or more of the conductive walls.

* * * * *